US006302745B1

(12) United States Patent
Landis et al.

(10) Patent No.: US 6,302,745 B1
(45) Date of Patent: Oct. 16, 2001

(54) KEYING SYSTEM FOR ELECTRICAL CONNECTORS

(75) Inventors: John M. Landis, Camp Hill; David J. Fabian, Mt. Joy, both of PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/549,636

(22) Filed: Apr. 14, 2000

Related U.S. Application Data

(60) Provisional application No. 60/129,158, filed on Apr. 14, 1999.

(51) Int. Cl.[7] ..... H01R 13/64
(52) U.S. Cl. ..... 439/681
(58) Field of Search ..... 439/680, 681, 439/677

(56) References Cited

U.S. PATENT DOCUMENTS

| | | | | |
|---|---|---|---|---|
| 4,159,862 | * | 7/1979 | Funck et al. | 439/681 |
| 4,778,411 | * | 10/1988 | Rudy, Jr. et al. | 439/681 |
| 5,125,849 | * | 6/1992 | Briggs et al. | 439/378 |
| 5,178,561 | * | 1/1993 | Lindeberg et al. | 439/571 |
| 5,273,462 | * | 12/1993 | Huser et al. | 439/681 |
| 5,357,243 | * | 10/1994 | Tice | 340/825 |
| 5,402,320 | * | 3/1995 | Kielstra et al. | 361/796 |
| 5,449,302 | * | 9/1995 | Yarbrough et al. | 439/680 |

FOREIGN PATENT DOCUMENTS

| | | |
|---|---|---|
| 0 033 286 A2 | 8/1981 | (EP) . |
| 1066672A | 4/1967 | (GB) . |
| WO89/02169 | 3/1989 | (WO) . |

* cited by examiner

*Primary Examiner*—Brian Sircus
*Assistant Examiner*—Thanh-Tam Le

(57) ABSTRACT

A key receiving member (140) for an electrical connector includes a body (142) having a key receiving slot (144) adapted to receive a key of a mating connector on one side thereof; and a plurality of complaint beams (146) extending downwardly from an opposite side of the body (142). At least some of the beams (146) include a retention projection (148) extending outwardly therefrom and adapted to engage a retention ledge (129) within a connector housing aperture (124) upon insertion of the member (140) into the aperture. At least one of the retention projections (146) includes a locking protrusion (150) extending outwardly therefrom for receipt into one of a plurality of detents (130) spaced around the ledge (129).

20 Claims, 6 Drawing Sheets

KEYING SYSTEM FOR ELECTRICAL CONNECTORS

This application claims benefit of Ser. No. 60/129,158 Apr. 14,1999.

FIELD OF THE INVENTION

The present invention is directed to electrical connectors and more particularly to a programmable keying system for mating connectors to assure that the desired connectors are mated.

BACKGROUND OF THE INVENTION

For purposes of illustrating the invention, the keying system will be discussed in relation to a stacked modular connector arrangement. It is to be understood that the keying system is not limited to use in such an arrangement. It is well known in the art to use a plurality of electrical input/output modules that fit together in a stacked arrangement and are electrically connected together. It is also known that the modules may be mounted to a U-shaped metal rail that supports the device and provides electrical connection to ground. It is further known that the use of a keying arrangement is desirable to assure that the correct connector pairs are mated to one another.

U.S. Pat. No. 4,738,632 discloses one such keying arrangement for a plurality of modules mounted to base units. Each base unit includes a pair of key members that may be positioned in a desired location by inserting a tool to remove the keying member from an aperture, manually turning the key member to a desired orientation and reinserting the member in the new orientation.

Other keying systems include hermaphroditic mating members, each having an essentially one-half of a post and a corresponding recess adapted to receive the cooperating portions of the other member. One example of this type may be found in U.S. Pat. No. 4,822,305. Again, these members must be removed from respective apertures of the mating connectors and manually reinserted into the apertures.

It is desirable, however, to have a keying system that does not require either partial or full removal of a member from an aperture of a housing to change the keying orientation, thereby saving assembly time.

It is further desirable to have a keying system that provides audible and tactile assurance that the desired orientation has been reached.

SUMMARY OF THE INVENTION

The present invention is directed to a programmable keying system that overcomes the problems associated with the prior art. The system includes a key receiving member configured to be received and secured within an aperture of a housing, such that the member may be rotated within the aperture to a desired orientation by means of a simple tool. The member furthermore provides both a tactile feel and an audible sound as the member is rotated within the aperture to the desired orientation.

The system includes at least a key receiving member for an electrical connector having a housing with an aperture dimensioned to receive said member. The programmable key receiving member includes a body having a key receiving slot adapted to receive a key of a mating connector on one side thereof; and a plurality of compliant beams extending downwardly from an opposite side of the body. At least one of the beams includes a retention projection extending outwardly therefrom and adapted to engage a retention ledge within the housing aperture upon insertion of the member into the aperture. At least one of the retention projections includes a locking protrusion extending outwardly therefrom. The retention ledge of the housing aperture further includes a plurality of detents spaced therearound and configured to receive the at least one locking protrusion therein. Upon inserting the key receiving member into the housing aperture from the mating face, the beams are compressed inwardly and resile outwardly upon full insertion such that the retention projections engage the ledge and the at least one locking protrusion is received in one of the detents. The key receiving member may be rotated to a desired keying position while remaining fully inserted in the housing aperture.

An embodiment of the key receiving member will now be described by way of example with reference to the accompanying drawings.

DETAILED DESCRIPTION OF THE DRAWINGS

Figure 1:
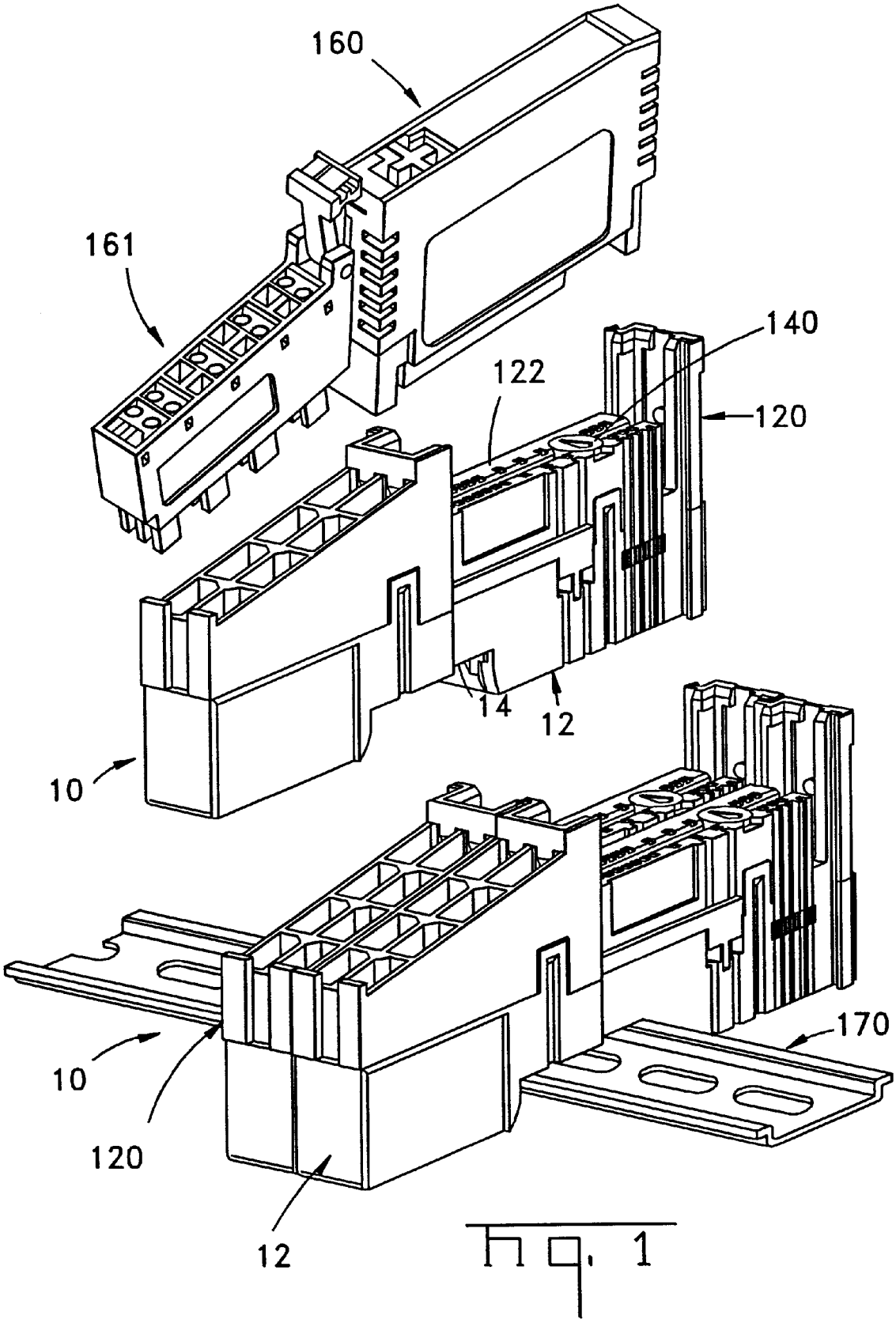
FIG. 1 is an isometric partially exploded view of an electrical system using the modular connector assembly of the present invention and illustrating two complementary mating connectors for one of the modules.

In FIG. 1 two modules, each identified as a connector assembly 10 of the present invention, are shown mounted to a rail 170 of an electrical device. A third connector assembly 10 is shown exploded from the rail 170. Two complementary mating connectors 160, 161 are shown exploded from the third assembly 10.

Figure 2:
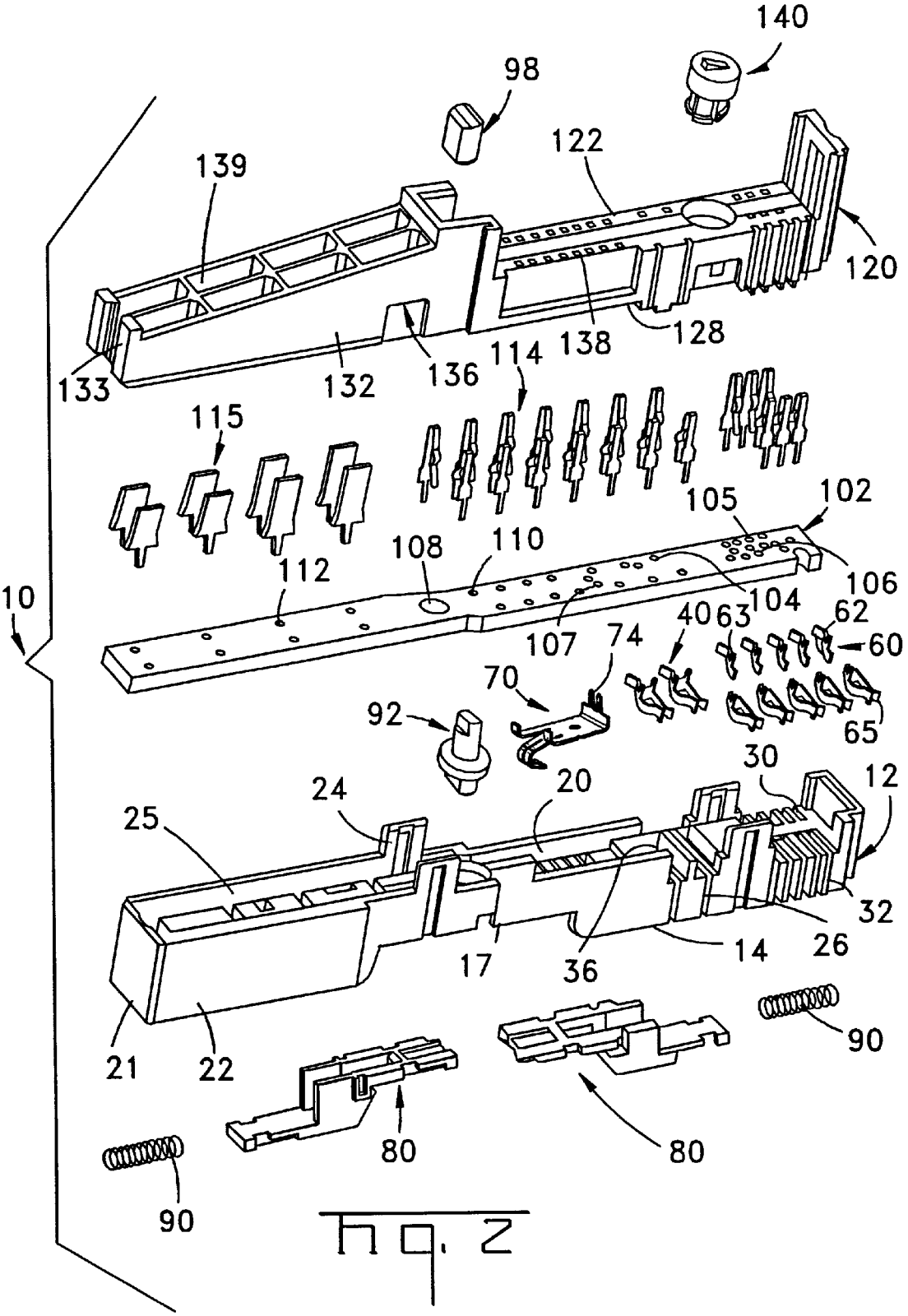
FIG. 2 is an isometric exploded view of one of the connector assembly modules of FIG. 1.

Referring now, to FIGS. 1 and 2, connector assembly 10 includes a lower housing 12 having a plurality of terminals 40, 60 and 70 disposed therein; an upper housing 120 securable to the lower housing 12 and having a plurality of terminals 114, 116 disposed therein and a circuit board 102 disposed between and within the housings 12, 120. Lower housing 12 has a rail mounting face 14 including a rail engaging recess 17, an assembly face 20, end walls 21, and side walls 22 having latch arms 24 extending upwardly therefrom and adapted to engage cooperating latch surfaces 136 on upper housing 120. End walls 21 and side walls 22 and assembly face 20 together define a circuit board receiving cavity 25 adapted to receive circuit board 102 therein. Housing 12 includes power terminal receiving passageways 26, data contact receiving cavities 30, 32 and ground terminal receiving cavity 36 for receiving respective power terminals 40, data terminal portions 62, 65, and ground terminal 70. Lower housing 12 further includes spring loaded rail engaging clamps 80 mounted to rail mounting face 14. Clamps 80 cooperate with springs 90 to hold connector assembly 10 on the rail 170, assembly 10 being released from the rail 170 by turning an actuator having lower portion 92 and upper portion 98. Further details about the operation of the rail engaging clamps are found in co-pending U.S. patent application Ser. No. 09/549,006 filed concomitantly herewith and incorporated by reference herein.

Upper housing 120 has a mating face 122, an assembly face 128 and opposed side walls 132 having latch surfaces 136 adapted to receive latch arms 24 to hold the two housings 12, 120 together. Housing 120 further includes terminal receiving cavities 138 and 139 for receiving respective terminals 114 and 116 therein. Upper housing 120 further includes the upper portion 98 of the actuator and a programmable key-receiving member 140 that cooperates with a key protrusion (not shown) on mating housing 160. Further details about the operation of the key-receiving member are described below.

As can best be seen in FIG. 2, power terminals 40, data terminals 60 including blade sections 62 and compliant arm sections 65, and ground terminal 70 are adapted to be mounted to one side of circuit board 102 and terminals 114 and 116 are adapted to be mounted to the other side of circuit board 102. The terminals may be mounted using complaint sections or solder tails that are received in apertures of board 102 to be electrically connected to circuits of the board. It is to be understood that the terminals may also be surface mounted to board 102 by means known in the art. It is to be further understood that the connector may include electronic components in addition to the terminals. Further details about the power and data terminals are found in co-pending U.S. patent application Ser. No. 09/549,264 filed concomitantly herewith and incorporated by reference herein.

Figure 3:
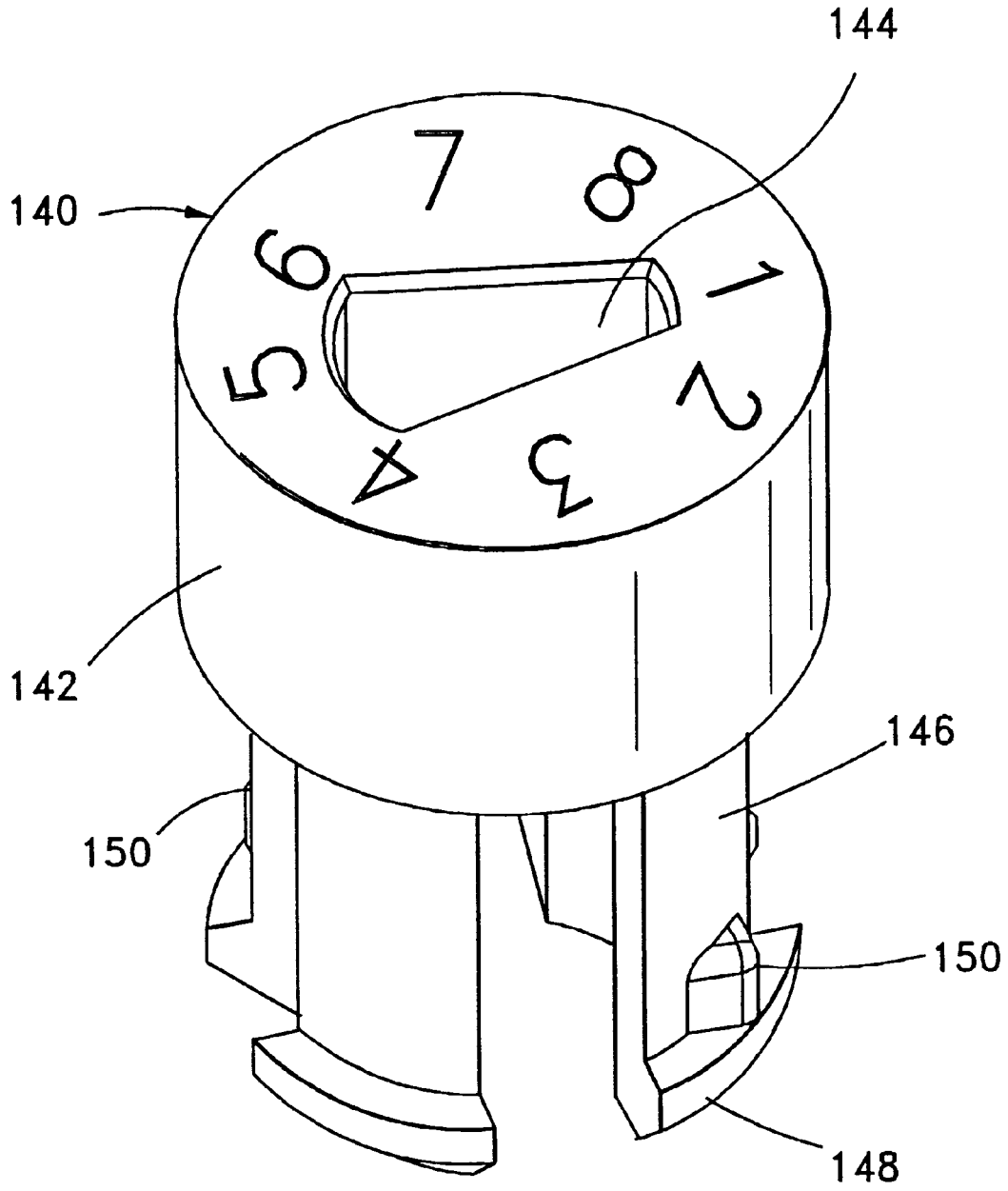
FIG. 3 is an isometric view of the key receiving member made in accordance with the present invention.

Referring now to FIGS. 3 through 6, programmable key receiving member 140 includes a body 142 and a plurality of complaint beams 146 extending from one side thereof, as best seen in FIG. 3. The other side of body 142 includes an aperture 144 therein configured to receive a keying member (not shown) of a mating connector 160 and a plurality of numbers indicating keying positions. It is to be understood that letters or other position indicating indicia also may be used. In the embodiment shown, key body 142 has four compliant beams 146 each including a retention projection 148 extending outwardly at the lower edge thereof. At least one of the beams 146 also includes a locking protrusion 150 on the projection 148.

Figure 4:
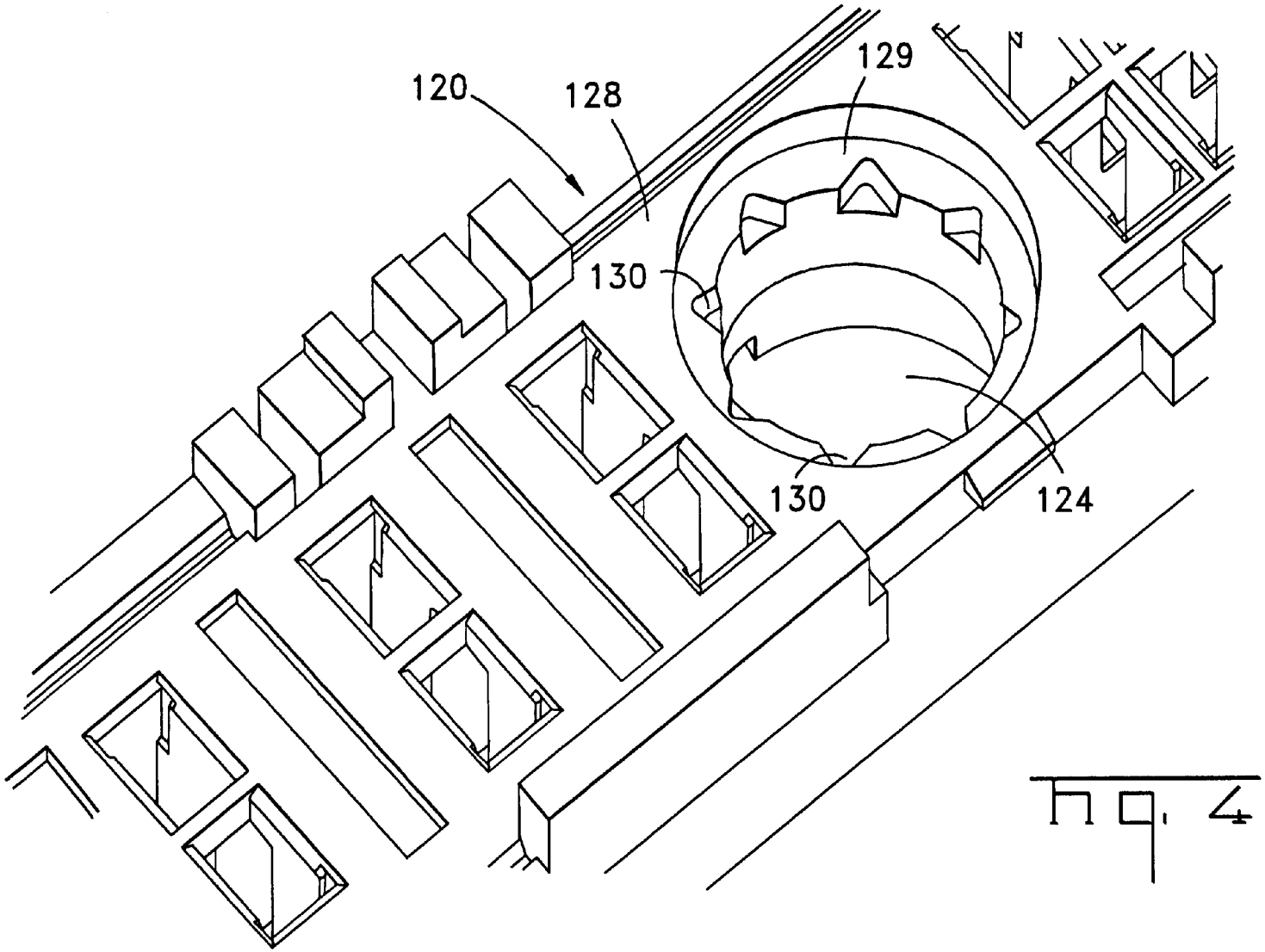
FIG. 4 is an enlarged fragmentary isometric view of the assembly face of the upper housing of the modular connector assembly illustrating the structure of the aperture for receiving the member of FIG. 3.
Figure 5:
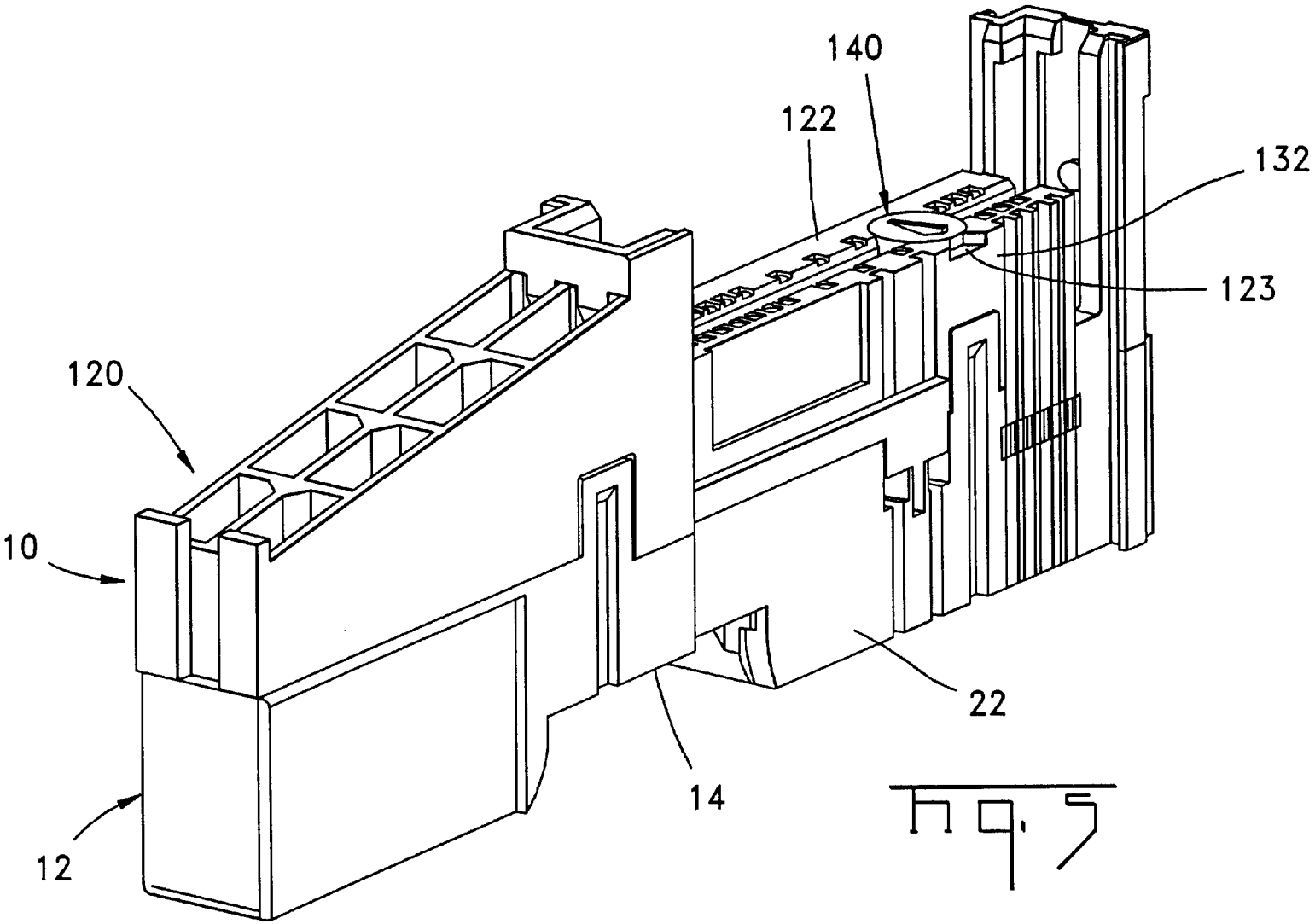
FIG. 5 is an isometric view of the connector assembly module of the present invention.
Figure 6:
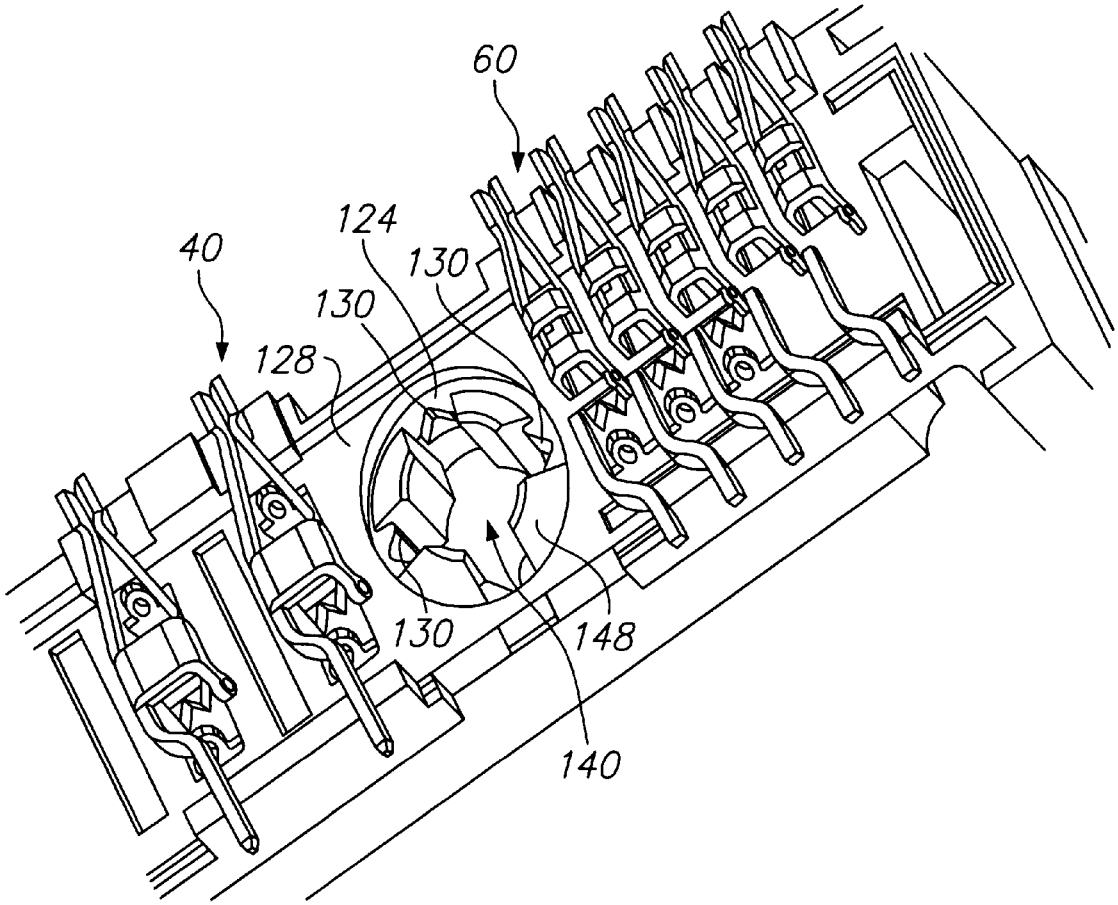
FIG. 6 is an isometric view illustrating the position of the key receiving member in the aperture and the position of a plurality of the terminals in the assembly with the circuit board being removed for purposes of illustration.

Upper housing 120 includes a key receiving aperture 124 extending from the mating face 122 to the assembly face 128. As best seen in FIGS. 4, 5 and 6, aperture 124 is configured to receive key receiving member 140 such that the top numbered surface is substantially flush with mating face 122 and the upper surfaces of retention projections 148 of beams 146 abut ledge 129 within aperture 124. Ledge 129 further includes a plurality of essentially triangular detents 130 extending into upper housing 120 around the circumference of aperture 124 configured to receive locking protrusion 150 therein to secure the key receiving member in the desired key location. The detents 130 provide camming surfaces that cooperate with locking protrusions 150 to position member 140 in the desired orientation. In the embodiment shown, two of the beams 146 include locking protrusions 150. In accordance with the invention, only one of the beams 146 needs a protrusion 150. It is to be understood that, if desired, a plurality or all of the beams may include protrusions 150. Since key receiving member 140 includes four beams that are evenly spaced apart and that the at least one beams 146 includes a protrusion 150 centered on projection 148, there are eight detents 130 defining the eight possible key positions. It is further to be understood that the key receiving member may have a different number of beams, spaces and protrusions to accommodate the desired number of keying locations.

Upon inserting key receiving member 140 into aperture 124, the compliant beams are compressed inwardly as retention projections engage walls of the aperture. The beams 146 resile outwardly upon full insertion whereby the locking projections 148 engage ledge 129 and the at least one locking protrusion 150 is received into one of the detents 130.

The position of the key receiving member 140 is determined by aligning the position mark or notch 123 on mating surface 122 with the associated number or letter on the upper surface of body 142. The key receiving slot 144 in body 142 is also adapted to receive a tool, such as a screw driver or the like that can be used to move key receiving member 140 to the desired orientation. In accordance with the invention, member 140 can be turned in either direction to change its position within aperture 124. There is no need to remove the member 140 from aperture 124, as is generally required in the prior art. Additionally as member 140 is being turned, the entrance of locking protrusion 150 into a corresponding detent provides both a tactile feel and an audible sound thereby assuring the operator that member 140 has been fully seated in the desired orientation.

Referring again to FIG. 2, one method of assembling connector assembly module 10 is to first dispose terminals 114 and 116 in respective cavities 138, 139 of upper housing 120. A circuit board subassembly can then be assembled by mounting the ground terminal 70, power terminals 40 and data terminals 60 in respective apertures 107, 104, 105 and 106 on the under side of circuit board 102. The upper side of the circuit board subassembly can then be disposed on the board mounting sections of terminals 114 and 116. The lower housing 12 having springs 90, rail engaging clamps 80 and lower actuator portion 92 disposed therein can then be secured to the upper housing and board subassembly. In the assembled connector lower actuator portion 92 extends through opening 108 of circuit board 102 and into the upper housing 120. Lastly, the upper actuator portion 98 and the key receiving member 140 are inserted into respective apertures in the upper housing 132.

The present invention provides a key receiving member that may be inserted into an aperture of a housing and be moved in either direction within the aperture to a plurality of key receiving orientations. The present invention eliminates the need to remove the member from the aperture. Additionally the member and aperture are configured to provide both a tactile feel and an audible sound as the member is moved from one position to another. The member requires a minimum of space in the connector housing.

It is thought that the key receiving member of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. A programmable key receiving member for an electrical connector, the connector including a housing with a mating face and an assembly face and an aperture, the aperture extending between the mating face and the assembly face and having a plurality of detents spaced circumferentially therearound, said member comprising:

a body having first and second opposed sides and a key receiving slot, the slot extending into said body from the first side and adapted to receive a key of a mating connector; and a plurality of compliant beams extending from said second body side away from said first body side, at least one of said beams including a locking protrusion extending radially outward therefrom and configured to be received in detents upon full insertion of said member into said aperture;

whereby upon inserting said key receiving member into said housing aperture from said mating face, said beams are compressed inwardly, said beams resiling outwardly upon full insertion into said aperture and said locking protrusion being received in one of said detents thereby defining a first position, said key receiving member being rotatable while remaining fully inserted in said housing aperture until said locking protrusion is received in a second one of said plurality of detents.

2. The programmable key receiving member of claim 1 wherein said aperture of said housing has a first portion having a first diameter and a second portion having a second diameter greater than said first diameter and defining a retention ledge therebetween, and wherein at least one of said beams includes a retention projection extending outwardly from a leading end of the beam and dimensioned to engage said retention ledge to secure said key receiving member in said aperture.

3. The programmable key receiving member of claim 2 wherein at least one of said plurality of beams include retention projections.

4. The programmable key receiving member of claim 2 wherein said plurality of detents within said aperture is defined on said retention ledge.

5. The programmable key receiving member of claim 4 wherein said locking protrusion is formed integrally with said retention projections.

6. The programmable key receiving member of claim 1 wherein at least one of said plurality of beams includes a locking protrusion.

7. The programmable key receiving member of claim 6 wherein said aperture of said housing has a first portion having a first diameter and a second portion having a second diameter greater than said first diameter and defining a retention ledge therebetween, and wherein at least one of said beams includes a retention portion extending outwardly from a leading end of the beam and dimensioned to engage said retention ledge to secure said key receiving member in said aperture.

8. The programmable key receiving member of claim 7 wherein at least one of said plurality of beams includes a retention projection.

9. The programmable key receiving member of claim 7 wherein said plurality of detents within said aperture are defined on said retention ledge.

10. The programmable key receiving member of claim 9 wherein at least one of said retention projections includes said locking protrusion.

11. The programmable key receiving member of claim 1 wherein said locking protrusion and said detents are dimensioned to provide a tactile feel as said key receiving member is rotated from one position to another.

12. The programmable key receiving member of claim 1 wherein said locking protrusion and said detents are dimensioned to provide an audible sound as said key receiving member is rotated from one position to another.

13. The programmable key receiving member of claim 1 wherein said locking protrusion and said detents are dimensioned to provide both a tactile feel and an audible sound as said key receiving member is rotated from one position to another.

14. The programmable key receiving member of claim 1 wherein said key slot is configured to receive a tool for rotating said key from one position to another within said aperture.

15. The programmable key receiving member of claim 1 wherein said member is configured to be rotatable in both a clockwise and a counterclockwise direction.

16. An electrical connector comprising:

a housing with a mating face and an assembly face and an aperture extending between the mating face and the assembly face, said aperture having a plurality of detents spaced circumferentially therearound;

a programmable key receiving member including a body having a key receiving slot adapted to receive a key of a mating connector on one side thereof; and a plurality of compliant beams extending downwardly from an opposite side of said body and adapted to be retained in said aperture of said housing, at least one of said beams including a locking protrusion extending outwardly therefrom and configured to be received in one of said detents within said aperture upon full insertion of said member into said aperture defining a first position;

whereby upon inserting said key receiving member into said housing aperture from said mating face, said beams are compressed inwardly, said beams resiling outwardly upon full insertion into said aperture and said locking protrusion being received in said detent of said first position, said key receiving member being movable to a second desired position while remaining fully inserted in said housing aperture upon rotating said member until said locking protrusion is received in a selected second of said plurality of detents within said aperture.

17. The electrical connector of claim 16 wherein said aperture of said housing has a first portion having a first diameter and a second portion having a second diameter greater than said first diameter and defining a retention ledge therebetween.

18. The electrical connector of claim 17 wherein at least one of said beams includes a retention portion extending outwardly from a leading end of the beam and dimensioned to engage said retention ledge to secure said key receiving member in said aperture.

19. The electrical connector of claim 18 wherein said plurality of detents within said aperture is defined on said retention ledge.

20. The electrical connector of claim 19 wherein at least one of said retention projections includes said locking protrusion.

* * * * *